US007182657B2

(12) United States Patent
Månsson

(10) Patent No.: US 7,182,657 B2
(45) Date of Patent: Feb. 27, 2007

(54) BOAT HULL WITH OUTBOARD DRIVE AND OUTBOARD DRIVE FOR BOATS

(75) Inventor: Staffan Månsson, Myggenäs (SE)

(73) Assignee: AB Volvo Penta, Göteborg (SE)

( * ) Notice: Subject to any disclaimer, the term of this patent is extended or adjusted under 35 U.S.C. 154(b) by 0 days.

(21) Appl. No.: 10/513,306

(22) PCT Filed: Apr. 29, 2003

(86) PCT No.: PCT/SE03/00689

§ 371 (c)(1),
(2), (4) Date: Jul. 26, 2005

(87) PCT Pub. No.: WO03/093105

PCT Pub. Date: Nov. 13, 2003

(65) Prior Publication Data

US 2005/0272321 A1 Dec. 8, 2005

(30) Foreign Application Priority Data

May 3, 2002 (SE) ..... 0201342

(51) Int. Cl.
*B63H 1/15* (2006.01)

(52) U.S. Cl. ..... 440/52; 440/112

(58) Field of Classification Search ..... 440/52, 440/112

See application file for complete search history.

(56) References Cited

U.S. PATENT DOCUMENTS

| | | | | |
|---|---|---|---|---|
| 2,977,923 | A * | 4/1961 | Bergstedt | 440/112 |
| 3,982,496 | A * | 9/1976 | Blanchard | 440/52 |
| 4,040,378 | A | 8/1977 | Blanchard | |
| 2002/0127928 | A1 * | 9/2002 | Buzzi | 440/75 |

* cited by examiner

*Primary Examiner*—Stephen Avila
(74) *Attorney, Agent, or Firm*—Martin Farrell

(57) ABSTRACT

Boat hull with outboard drive unit, said drive unit (5) comprising an underwater housing (6) mounted on the outside of the hull bottom (1) and a gear housing (11) mounted on the inside of the hull bottom and joined to the underwater housing. Between the underwater housing and the gear housing there is fixed a mounting plate (20), which, together with a screw-down plate (24), with elastic ring (23, 27) inserts, fixes the drive unit to a flange (4), which is made on the inside of a well (3) surrounding an opening (2) in the hull bottom.

15 Claims, 2 Drawing Sheets

BOAT HULL WITH OUTBOARD DRIVE AND OUTBOARD DRIVE FOR BOATS

Figure 1:
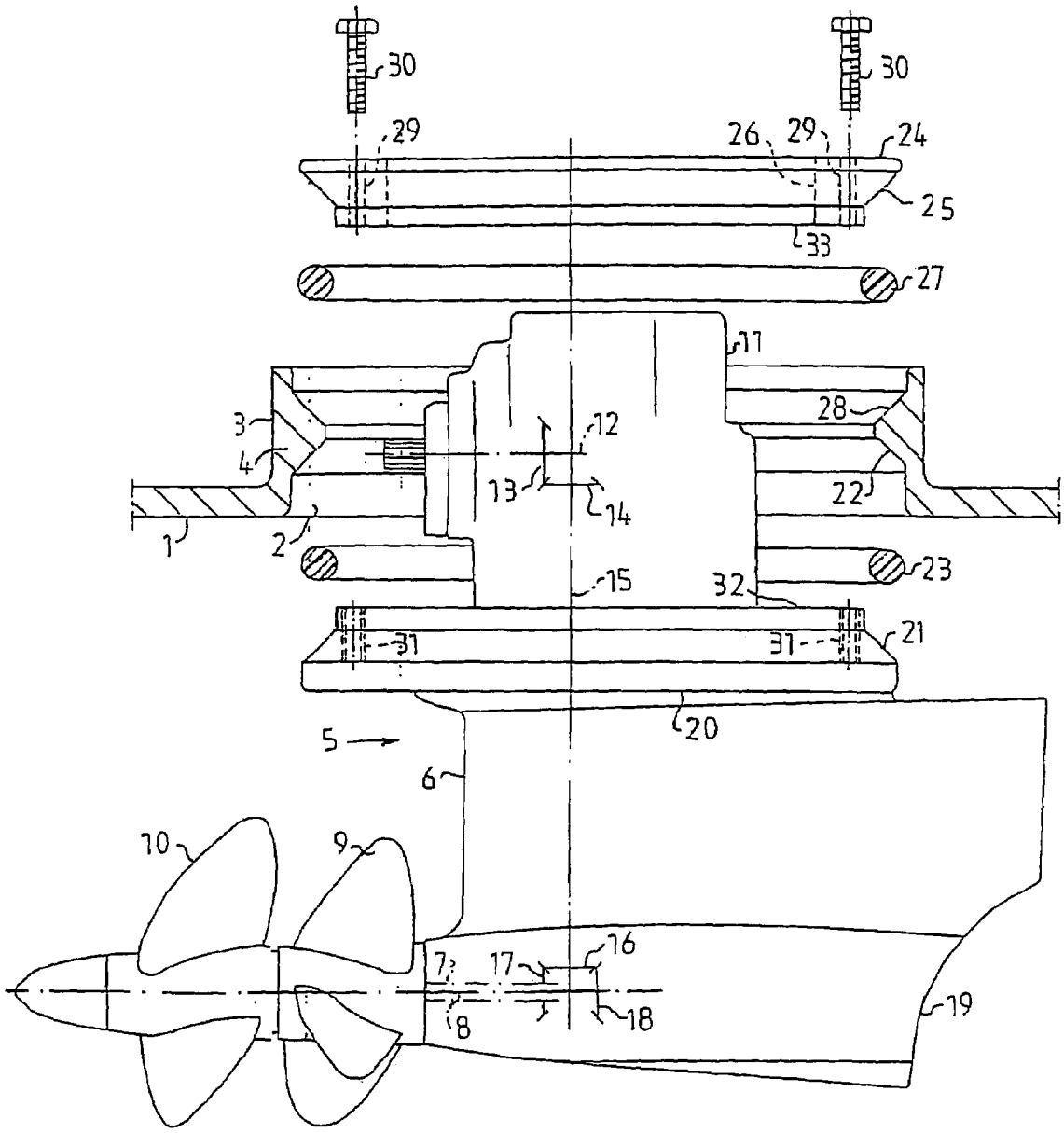

The present invention relates to a boat hull with an outboard drive unit for at least one propeller, said drive unit comprising an underwater housing extending down from the outside of the hull bottom, and an at least substantially vertical drive shaft being rotatably mounted in said underwater housing, extending through an opening in the bottom of the hull and driving, via a bevel gearing enclosed in said underwater housing, at least one at least substantially horizontal propeller shaft mounted in said underwater housing The invention relates also to an outboard drive unit for boats for driving at least one propeller, comprising, firstly, an underwater housing in which there is rotatably mounted a drive shaft, which is substantially vertical in the operating state of the drive unit, and said drive shaft being drivably coupled via a bevel gearing at a lower end to at least one propeller shaft mounted in the underwater housing, and, secondly, a gearing housing joined to the underwater housing and comprising a second bevel gearing, via which the upper end of said essentially vertical drive shaft is drivably coupled to a substantially horizontal shaft, and mounting means for mounting the drive unit with the underwater housing on the outside and the gearing housing on the inside of a boat hull.

Previously known outboard drive units of the type presently in question, which have a leg or underwater body extending down from the underside of the hull bottom, have been mounted in two different manners. In one case, the leg is rigidly joined to the engine and extends through an opening in the hull bottom, with a rubber bellows or the like forming a seal between the leg and the edge of the surrounding opening. The pushing forces of the propeller are taken up by the engine and the engine mounting. In the second case, the leg or the underwater housing is fixed to a plate which is screwed securely, or fixed in some other manner, to the bottom of the hull. In this case the entire propeller force can be taken up by the hull or a portion can be taken up by the hull and a portion by the drive unit mounted on the inside of the hull, i.e. the engine and transmission.

Common to both alternatives is that the mounting work is relatively complicated, due to the fact that a significant mounting work is required for making the hole, fitting and fixing both from the outside of the hull bottom and from the engine compartment on the inside.

One purpose of the present invention is to achieve a boat hull with an outboard drive unit of the type described by way of introduction, which permits maximally rapid and simple mounting of the drive unit in the hull and where essentially all the work after fitting of the drive unit in the opening in the hull bottom can be done from above, thereby making it possible to avoid physically tiring up-and-under work.

This is achieved according to the invention by virtue of the fact that the opening is so dimensioned that a housing portion joined to the underwater housing is insertable from below through the opening to a position on the inside of the hull, that the bottom of the hull is provided with a well surrounding said opening and extending up into the interior of the hull, said well being made with an inwardly directed peripheral flange, which, with an elastic insert on each side, is held tightly between a mounting plate rigidly joined to the underwater housing and/or said housing portion and a screw-down plate fastened to the mounting plate, said plates having shapes adapted to the opening and to the peripheral flange.

The flange and the screw-down and mounting plates may have a non-circular shape and be provided with profiles fitted to each other so that they can only be mounted in one manner relative to each other. The screw-down plate can be provided with peripherally spaced through-bores for screw-down bolts and the mounting plate may have corresponding threaded bores for these bolts. After fitting the underwater body in the well with associated elastic elements abutting against the underside of the flange, all that is required is to put the screw-down plate in place from above with the second elastic element between it and the flange and to tighten the screw-down plate against the mounting plate with the aid of the bolts.

An outboard drive unit of the type described by way of introduction is characterized, according to the invention, in that said mounting means comprise a mounting plate rigidly joined to the underwater housing and/or the gear housing, a screw-down plate and elastic inserts for clamping the drive unit against a peripheral flange in a well in the bottom of a boat hull, with the mounting plate and an elastic insert on one side and the screw-down plate and an elastic insert on an opposite side of the flange.

Figure 2:
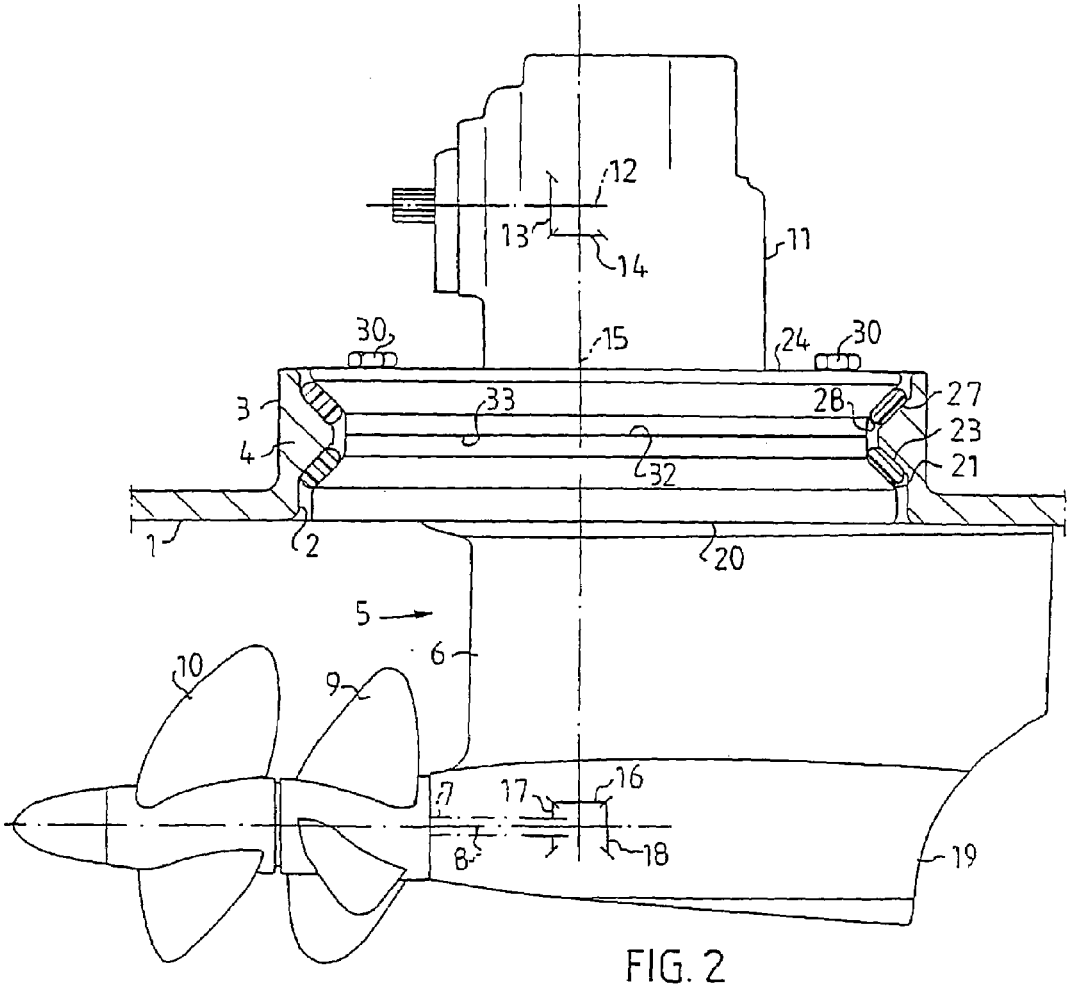

The invention will now be described in more detail with reference to examples shown in the accompanying drawings, where FIG. 1 shows a longitudinal section through a portion of a boat bottom with a side view of one embodiment of an outboard drive unit with associated mounting means prior to mounting, and FIG. 2 shows a corresponding longitudinal section and side-view after mounting.

In the figures, 1 designates the bottom of a boat hull, which can be cast fibreglass reinforced polyester plastic. The bottom 1 of the hull is made with an opening 2 which is surrounded by a vertical well 3, extending up into the interior of the hull. The well 3 is preferably cast in one piece with the bottom 1 and is provided with an inwardly directed, peripheral flange 4, which, in the example shown, has a substantially triangular cross section.

The well 3 with the flange 4 forms mounting means for a propeller drive unit generally designated 5, which, in the example shown, has an underwater housing 6, in which two concentric propeller shafts 7 and 8, respectively, have rotatably mounted individual propellers 9 and 10, respectively. The underwater housing 6 is joined to an upper gear housing 11, in which a horizontal drive shaft 12 is rotatably mounted.

The shaft 12 is intended to be coupled to a power plant (not shown). The shaft 12 drives, via a bevel gearing comprising bevel gears 13 and 14 enclosed in the gear housing 11, a vertical shaft 15, which in turn drives, via a second bevel gearing having bevel gears 16, 17 and 18 enclosed in an underwater housing, the propeller shafts 7 and 8 counter-rotationally. In the example shown, the propellers 9 and 10 are pulling propellers disposed forward of the underwater housing 6, in the aft end of which there is an exhaust port 19.

Between the underwater housing 6 and the upper gearing housing 11, there is, in accordance to the invention, a mounting plate 20 fixed, which can be cast metal, e.g. aluminium, or moulded fibreglass reinforced plastic. The plate 20 is, as is the well 3, preferably oval in shape in horizontal projection. The plate 20 has furthermore a conical upwardly facing lateral edge surface 21 and the flange 4 has a corresponding conical downwardly directed lateral edge surface 22. By providing the plate 20 and the well 3 with a shape which is non-circular, together with inclined lateral edge surfaces 21 and 22, controlled alignment of the drive 5 is achieved relative to the bottom 1 of the hull, when the drive 5 is mounted from below into the well 3, as illustrated in FIG. 1.

Before the drive 5 with its mounting plate 20 is inserted into the well 3, there is placed against the lateral edge 21 of the plate 20 a ring 23 of elastic material of e.g. rubber, with a circular cross section and oval shape adapted to the flange 4 and the lateral edges 21, 22 of the plate 20. A screw-down plate 24 with a downwardly facing conical lateral edge surface 25 and an opening 26, which the gearing housing 11 can pass through, is placed with an intermediate second ring 27 corresponding to ring 23 towards an upwardly facing conical lateral surface 28 of the flange. The screw-down plate 24 is then screwed tightly against the mounting plate 20 with the aid of bolts 30 disposed in through-bores 29 in the screw-down plate 24. Said bolts 30 can be screwed into threaded bores 31 in the mounting plate 20, compressing the elastic rings 23 and 27. The thicknesses of the mounting plate 20 and the screw-down plate 24 are so adapted to each other that, when the screw-down plate is screwed securely to the mounting plate so that the facing surfaces 32 and 33 of the plates are in contact with each other, the elastic rings 23 and 27 are compressed to a thickness corresponding to a thickness corresponding to the ring radius before being mounted. By virtue of the described design and dimensional relations, the orientation and mounting of the drives will be completely controlled.

The propeller pulling force is transmitted via the plates 20 and 24, the rings 23 and 27, the flange 4 and the well 3 to the boat hull. The engine, possibly with reverse, is thus freed from the propeller pulling force and can therefore be mounted on relatively soft vibration-damping pads. The transmission of vibrations from the drive to the hull is damped by the elastic rings 23 and 27, of which the lower ring 23 also serves as a seal preventing the penetration of water into the well 3.

The invention has been described above with reference to an embodiment with two separate elastic rings 23 and 27. It is also possible within the scope of the invention to use elastic elements on other side of the flange, forming a continuous unit, for example by means of a membrane, which joins the elements to each other. The definition "an elastic insert on each side" in the attached claims shall be interpreted as referring either to interconnected or separate elastic inserts.

The invention claimed is:

1. A boat hull with a bottom-mounted drive unit for at least one propeller, said drive unit comprising an underwater housing extending downward from the hull bottom, a drive shaft rotatably mounted in said underwater housing, the drive shaft extending through an opening in the hull bottom, a first gear arrangement enclosed in said underwater housing coupling the drive shaft to at least one propeller shaft mounted in said underwater housing, and a gear housing portion joined to the underwater housing, the hull bottom including a well surrounding said opening and extending into an interior of the hull, said well including an inwardly directed peripheral flange, wherein the well peripheral flange are manufactured in one piece with the hull bottom, and wherein the flange has a substantially triangular cross-section, and further comprising an elastic insert contacting each side of the peripheral flange, a mounting plate rigidly joined to at least one of the underwater housing and the housing portion, and a screw-down plate fastened to the mounting plate with the peripheral flange therebetween, the elastic insert being held between the mounting plate, peripheral flange and screw down plate, said plates having shapes adapted to the opening and to the peripheral flange.

2. A boat hull with a bottom-mounted drive unit according to claim 1, wherein said elastic insert comprises upper and lower elastic rings, pressed against an upper and a lower surface, respectively of the peripheral flange.

3. A boat hull with a bottom-mounted drive unit according to claim 2, wherein said elastic rings in an unloaded state have at least a substantially circular cross section and when clamped against the peripheral flange between the mounting plate and the screw-down plate are compressed to a thickness approximately equal to the radius of the rings in the unloaded state.

4. A boat hull with a bottom-mounted drive unit according to claim 1, wherein the mounting plate is fixed between the underwater housing and a the gear housing portion, the gear housing portion enclosing a gear arrangement for coupling the drive shaft to an output shaft of a motor.

5. A boat hull with a bottom-mounted drive unit according to claim 1, wherein the screw-down plate and the mounting plate are screwed securely to each other by peripherally spaced screws disposed inside of said peripheral flange.

6. A boat hull with a bottom-mounted drive unit according to claim 1, wherein the hull bottom, the well and the flange are cast in one piece of fiberglass reinforced polyester plastic.

7. A outboard hull bottom-mounted drive unit for driving at least one propeller of a boat, comprising, an underwater housing in which there is therein a rotatably mounted drive shaft, which in the operating state of the drive unit, and said drive shaft being drivably coupled via a bevel gearing at a lower end by a first pear arrangement to at least one propeller shaft mounted in the underwater housing, a gearing housing joined to the underwater housing and comprising a second bearing arrangement drivably coupling via the upper end of said essentially vertical drive shaft is drivably coupled to an input shaft, and mounting means for mounting the drive unit with the underwater housing outside and the inside of a boat hull, characterized in that wherein said mounting well defining an opening in a bottom of a boat hull and having a peripheral flange extending therefrom, a mounting plate rigidly joined to at least one of the underwater housing and the gear housing a screw-down plate disposed on a side of the peripheral flange opposite the mounting plate, and elastic inserts disposed between the mounting plate and the peripheral flange and the screw-down plate and the peripheral flange, the drive unit being clamped against the peripheral flange in the bottom of a boat hull, with the mounting plate and an elastic insert on one side and the screw-down plate and an elastic insert on an opposite side.

8. The hull bottom-mounted drive unit according to claim 7, wherein two counter-rotatingly driven, concentric propeller shafts with individual pulling propellers are mounted in the underwater housing.

9. A boat hull with a bottom-mounted drive unit for at least one propeller, said drive unit comprising:

a first housing extending from an outer surface of the hull bottom;

a drive shaft rotatably mounted in said underwater housing and extending through an opening in the bottom of the hull and coupled by a first gear arrangement enclosed in said underwater housing to at least one propeller shaft mounted in said underwater housing;

a gear housing portion joined to the underwater housing being insertable from below through the opening in the bottom of the hull to a position inside the hull, the gear housing enclosing a second gear arrangement for coupling the drive shaft to an input shaft of a motor, wherein, the hull comprises a well surrounding said opening and extending up into an interior defined by the hull, said well including an inwardly directed peripheral flange; and, further comprising:

a mounting plate rigidly joined to at least one of the underwater housing and said gear housing portion and disposed between the underwater housing and the gear housing portion;

a screw-down plate fastened to the mounting plate with the peripheral flange therebetween, said plates having shapes adapted to the opening and to the peripheral flange; and, an elastic insert arrangement clamped between the mounting plate and peripheral flange and the screw-down plate and peripheral flange.

10. A boat hull with a bottom-mounted drive unit for at least one propeller, comprising:

an upper substantially flat mounting surface and a lower substantially flat mounting surface formed about a periphery of an opening in the hull bottom;

a screw down plate having a substantially flat mounting surface, said screw down plate mounting surface being disposed against and in parallel to said upper mounting surface;

an underwater housing extending downward from the hull bottom enclosing a rotatably mounted drive shaft, the drive shaft extending downward from the hull, a first gear arrangement, and at least one propeller shaft, the first gear arrangement coupling the drive shaft to the at least one propeller shaft;

a gear housing portion joined to an upper side of the underwater housing;

a mounting plate joined to at least one of the underwater housing and the gear housing portion and having a substantially flat mounting surface, the mounting plate mounting surface being disposed against and in parallel to said lower mounting surface, wherein, said screw down plate and said mounting plate are fastened together with said upper mounting surface and said lower mounting surface therebetween; and, an elastic insert arrangement disposed between the screw down plate and upper mounting surface and between the mounting plate and lower mounting surface, the elastic insert being deformably compressed between opposed parallel mounting surfaces.

11. The boat hull as claimed in claim 10, wherein said upper substantially flat mounting surface and said lower substantially flat mounting surface are on a flange formed on the periphery of the hull opening.

12. The boat hull as claimed in claim 11, wherein the flange has a substantially triangular cross-section.

13. The boat hull as claimed in claim 10, wherein said elastic insert comprises upper and lower elastic rings disposed between the screw down plate and upper mounting surface and the mounting plate and the lower mounting surface, respectively.

14. The boat hull as claimed in claim 13, wherein said elastic rings in an unloaded state have at least a substantially circular cross section and when clamped against the peripheral flange between the mounting plate and the screw-down plate are compressed to a thickness approximately equal to the radius of the rings in the unloaded state.

15. The boat hull as claimed in claim 10, wherein the mounting plate is fixed between the underwater housing and the gear housing portion, the gear housing portion enclosing a gear arrangement for coupling the drive shaft to an output shaft of a motor.

* * * * *